US005283226A

United States Patent [19]

Simpson et al.

[11] Patent Number: 5,283,226

[45] Date of Patent: Feb. 1, 1994

[54] PROCESS FOR PREPARING DYE-DONOR ELEMENT FOR THERMAL DYE TRANSFER SYSTEM PROCESSING

[75] Inventors: William H. Simpson, Pittsford; Jacob J. Hastreiter, Jr., Spencerport, both of N.Y.

[73] Assignee: Eastman Kodak Company, Rochester, N.Y.

[21] Appl. No.: 16,620

[22] Filed: Feb. 12, 1993

[51] Int. Cl.[5] ..... B41M 5/035; B41M 5/38

[52] U.S. Cl. ..... 503/227; 428/195; 428/478.2; 428/913; 428/914; 430/201; 430/945

[58] Field of Search ..... 8/471; 428/195, 478.2, 428/913, 914; 430/200, 201, 945; 503/227

[56] References Cited

U.S. PATENT DOCUMENTS 5,214,023 5/1993 Aono ..... 503/227

FOREIGN PATENT DOCUMENTS

61/262190 11/1986 Japan ..... 503/227

*Primary Examiner*—B. Hamilton Hess

*Attorney, Agent, or Firm*—Harold E. Cole

[57] ABSTRACT

This invention relates to a process of preparing a dye-donor element used in thermal dye-transfer processing comprising:

a) coating a support with a dye layer comprising an image dye dispersed in a binder, the binder comprising a hydrophilic polymer coated from an aqueous solution containing a surfactant;

b) washing the dye-donor element with water to remove residual surfactant in the dye layer; and c) drying the dye-donor element.

16 Claims, No Drawings

PROCESS FOR PREPARING DYE-DONOR ELEMENT FOR THERMAL DYE TRANSFER SYSTEM PROCESSING

This invention relates to a process for preparing a dye-donor element used in a thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

Dye-donor elements used in thermal dye transfer processing usually consist of a suitable support coated with a dye layer. The dye layer may be produced by casting a solvent solution of an organic dye, which also contains a mutually soluble binder, or by applying an aqueous dispersion of dye in a hydrophilic binder.

In JP 61/262,190, there is a disclosure of aqueous dispersions of binders for a dye-donor element for laser thermal dye transfer systems. These binders include natural resins, such as gum arabic, dextrin, casein, cellulosic resins, as well as polyvinyl alcohols and polyvinyl acetates.

In U.S. Ser. No. 980,895 of Neumann et al., filed Nov. 24, 1992, solid particle dye dispersions for a laser thermal dye-transfer donor are prepared by milling organic dyes in the presence of water and a surfactant. A dispersion of carbon black is made separately in a similar manner. The stable dispersions thus made are blended together in the correct proportions with a binder such as gelatin.

Although donors coated with such aqueous dispersions are useful in thermal dye transfer processing, they contain relatively high levels of surfactants or coating aids used in the coating process. The surfactants or polyelectrolyte dispersants are used in making the aqueous dye dispersion and serve to wet the particle surface during mechanical attrition and stabilize the dispersion against agglomeration after the mechanical process is completed. A problem has been found with having surfactants in the dye-donor in that they transfer during thermal dye transfer processing and contribute to image degradation.

It is an object of this invention to provide a process for making a dye-donor element containing an aqueous dispersion binder which would improve the image quality obtained upon thermal processing.

These and other objects are achieved in accordance with this invention which relates to a process of preparing a dye-donor element used in thermal dye-transfer processing comprising:

a) coating a support with a dye layer comprising an image dye dispersed in a binder, the binder comprising a hydrophilic polymer coated from an aqueous solution containing a surfactant;

b) washing the dye-donor element with water to remove residual surfactant in the dye layer; and c) drying the dye-donor element.

In a preferred embodiment of the invention, the water used to wash the element is deionized. In another preferred embodiment, the washing water contains a salt, such as sodium sulfate, sodium acetate or potassium chloride.

In accordance with the invention, by decreasing the surfactant level in the dried coating by extraction with water or a salt solution, beneficial effects of increased sharpness of edges and higher dye density at the same exposure are obtained. Higher densities at the same exposure equate to faster writing speeds in thermal imaging systems.

Any hydrophilic polymer may be used in the invention. In a preferred embodiment, hydrophilic polymers are used which is "settable" when coated, i.e., its viscosity vs. temperature curve shows a discontinuity due to formation of a three-dimensional network at this setting point of the binder.

Such settable hydrophilic polymers include, for example, gelatin; thermoreversible materials that gel on cooling, e.g., corn and wheat starch, agar and agarose materials, xanthan gums, and certain polymers derived from acrylamides and methacrylamides as disclosed in U.S. Pat. Nos. 3,396,030 and 2,486,192; thermoreversible materials that gel on heating, e.g., certain polyoxyethylene-polyoxypropylenes as disclosed by I.R. Schmolka in J. Am. Oil Chem. Soc., 1977, 54, 110 and J. Rassing, et al., in J. of Molecular Liquids, 1984, 27, 165; some polysaccharides; and polymers with a hydrophilic group from a water-soluble ionic vinyl monomer and a hydrophobic group from an acrylamide or methacrylamide as disclosed in U.S. Ser. No. 742,784, of Roberts et al., filed Aug. 8, 1991,now abandoned.

The hydrophilic polymer used in the invention can be employed at a coverage of from about 0.2 to about 5 $g/m^2$.

The results obtained with this invention are not limited to one surfactant or a class of surfactants. Anionic surfactants are preferable in the imaging industry because of a general compatibility with other materials. Examples of these surfactants include TX200 ® (Union Carbide), a sodium salt of alkylaryl polyether sulfonate; Tamol SN ® (Rohm & Haas), a sodium salt of condensed naphthalenesulfonic acid; Aerosol OT ® (American Cyanimid), a dioctyl ester of sodium sulfosuccinic acid; Lomar D ® (Henkel Canada Ltd.), a sodium polynaphthalene sulfonate; Marasperse ® (Daishowa Chemicals), a modified lignosulfonate; and Zonyl FSA ® (E.I. DuPont de Neumours & Co.), a fluorochemical anionic surfactant.

Any image dye can be used in the dye-donor employed in the invention provided it is transferable to the dye-receiving layer. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku,Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

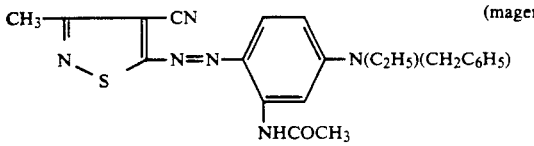
(magenta)

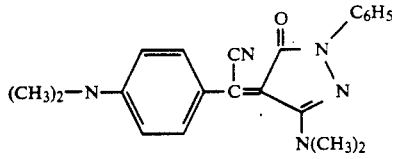
(magenta)

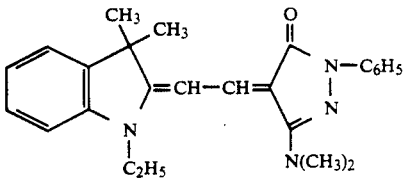
(yellow)

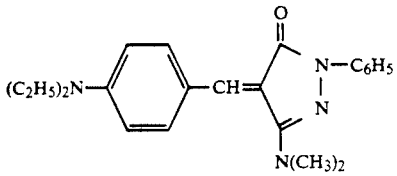
(yellow)

-continued

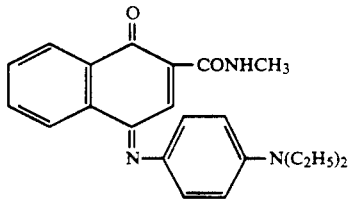
(cyan)

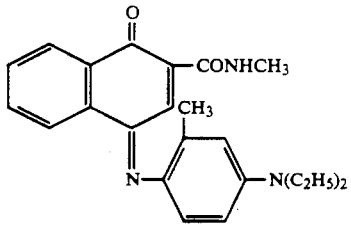
(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene,; polyacetals; polyolefins such as polystyrene, polyethylene, polypropylene or methylpentene polymers; and polyimides such as polyimide-amides and polyether-imides. The support generally has a thickness of from about 5 to about 200 μm and may also be coated with a subbing layer, if desired, such as those materials described in U.S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semicrystalline organic solids that melt below 100° C. such as poly(vinyl stearate), beeswax, bayberry wax, candelilla wax, carnauba was, ceresine wax, Japan wax, montan wax, ouricury wax, rice bran wax, paraffin wax, microcrystalline wax, perfluorinated alkyl ester polyethers, polycaprolactone, silicone oils, polytetrafluoroethylene, carbowaxes, poly(ethylene glycols), or any of those materials disclosed in U.S. Pat. Nos. 4,717,711: 4,717,712; 4,737,485; and 4,738,950, and EP 285,425, page 3, lines 25–35. The waxes may be used in combination with silicone oils as mixtures or the waxes may be used to microencapsulate the silicone oils. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used. The dye-receiving element may also comprise a solid, injection-molded material such as a polycarbonate, if desired.

The dye image-receiving layer may comprise, for example, a polycarbonate, a polyurethane, a polyester, poly(vinyl chloride), poly(styrene co acrylonitrile), polycaprolactone, a poly(vinyl acetal) such as poly(vinyl alcohol-co-butyral), poly(vinyl alcohol-co-benzal), poly(vinyl alcohol-co-acetal) or copolymers or mixtures thereof. The dye image-receiving layer may be present in any amount which is effective for the intended purpose. In general, good results have been obtained at a concentration of from about 1 to about 5 g/m$^2$.

As noted above, the dye-donor elements prepared in accordance with the invention are used to form a dye transfer image. Such a process comprises imagewise-heating a dye-donor element prepared as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black or cyanine infrared-absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in U.S. Pat. No. 5,168,288, the disclosure of which is hereby incorporated by reference.

The following examples are provided to illustrate the invention.

EXAMPLE 1

Solid dispersions of image dyes in water were prepared by milling the dye in a ball mill in the presence of Triton X200® surfactant (Union Carbide Co.) until the average particle size was less than 5 μm. A dispersion of carbon black in water was prepared in the same manner also using TX200®. A detailed description of this process can be found in U.S. Ser. No. 980,895 of Neumann et al., filed Nov. 24, 1992, referred to above. The dyes used in this example were the second cyan, the first magenta, and second yellow dye illustrated above.

The coating solutions made from the respective dye dispersions are given in Table I where the final dye concentration, carbon concentration, gelatin level and surfactant level in each dispersion are shown.

TABLE I

| COATING MELTS | |
|---|---|
| MATERIAL | CONCENTRATION (mg/cc) |
| Cyan Coating Melt | |
| Cyan Dye (TX200 ® @ 10%) | 24.3 |
| Type IV Deionized Gelatin | 3.3 |
| Carbon (TX200 ® @ 10%) | 6.7 |
| Magenta Coating Melt | |
| Magenta Dye (TX200 ® @ 10%) | 52.8 |
| Type IV Deionized Gelatin | 3.3 |
| Carbon (TX200 ® @ 10%) | 6.7 |
| Yellow Coating Melt | |
| Yellow Dye (TX200 ® @ 10%) | 13.8 |
| Type IV Deionized Gelatin | 3.3 |
| Carbon (TX200 ® @ 10%) | 6.7 |

The solutions were coated on a poly(ethylene terephthalate) support which had been previously subbed with gelatin which contained 9 μm divinylstyrene beads to form a donor for laser-induced thermal dye-transfer imaging. The coating weights are given for each donor (cyan, magenta, and yellow) in Table II.

TABLE II

| DYE DONORS | |
|---|---|
| MATERIAL | COATING WEIGHT ($mg/m^2$) |
| Cyan Donor | |
| Cyan Dye (TX200 ® @ 10%) | 783 |
| Type IV Deionized Gelatin | 108 |
| Carbon (TX200 ® @ 10%) | 215 |
| Magenta Donor | |
| Magenta Dye (TX200 ® @ 10%) | 568 |
| Type IV Deionized Gelatin | 108 |
| Carbon (TX200 ® @ 10%) | 215 |
| Yellow Donor | |
| Yellow Dye (TX200 ® @ 10%) | 445 |
| Type IV Deionized Gelatin | 108 |
| Carbon (TX200 ® @ 10%) | 215 |

Sample pieces of each donor were cut to approximately 70 $mm^2$.

The washed coatings were obtained as follows: Two 70 mm pieces of a cyan donor coating were placed into a plastic tray (approximately 22×28×4 cm deep) which had been filled to within 1.25 cm from the top with a 0.2% (wt/wt) sodium sulfate solution. The solution was gently agitated by tilting the tray so that the solution moved back and forth. The total time of washing was thirty minutes. Each piece of cyan donor was removed and allowed to dry in the air for twenty-four hours. The procedure was repeated for two pieces of magenta and one piece of yellow donor.

After drying, the pieces of donor were used to write a colored test image onto a molded piece of GE Lexan ® SP1010 polyester-polycarbonate copolymer receiver. The exposure device used in this test was a laser printer similar to the one described in U.S. Pat. Nos. 5,105,206 and 5,168,288; this machine had been previously programmed with the cyan, magenta, and yellow records of the test image. Each piece of donor was separately laminated with the receiver and exposed with an 830 nm laser.

The pieces were exposed to laser light in the sequence of two cyan, two magenta, and one yellow donor sample (CCMMY) to form an image of a 5 density step tablet in each of cyan, magenta, and yellow onto the receiver.

A control was used comprising an image formed from the donor as coated without washing and redrying. The test represented a set of CCMMY donor samples which had been washed in one of the solutions shown in the "donor treatment" column of Table III. After writing an image onto the receiver, with the control donor and test donors separately, the images were fused by heating. The density of each step was then read using an X-Rite densitometer (X-Rite Co., Grandville, Mich.) with the results shown in Table III.

TABLE III

| OBSERVED STATUS A TRANSMISSION DENSITIES | | | | | | |
|---|---|---|---|---|---|---|
| Donor Treatment* | Dye | Step 1 | Step 2 | Step 3 | Step 4 | Step 5 |
| 0.1% TX200 ® | C | 0.93 | 1.26 | 1.77 | 2.34 | 2.32 |
| | M | 0.79 | 1.08 | 1.57 | 2.03 | 2.49 |
| | Y | 0.79 | 1.11 | 1.56 | 1.92 | 1.97 |
| 0.2% $Na_2SO_4$ | C | 0.99 | 1.38 | 1.92 | 2.43 | 2.47 |
| | M | 0.86 | 1.18 | 1.70 | 2.07 | 2.48 |
| | Y | 0.87 | 1.17 | 1.58 | 1.91 | 1.88 |
| Deionized Water | C | 1.03 | 1.42 | 1.97 | 2.46 | 2.50 |
| | M | 0.90 | 1.20 | 1.69 | 2.10 | 2.44 |
| | Y | 0.90 | 1.20 | 1.61 | 1.94 | 1.91 |
| None | C | 0.91 | 1.30 | 1.85 | 2.35 | 2.38 |

TABLE III-continued

| OBSERVED STATUS A TRANSMISSION DENSITIES | | | | | | |
|---|---|---|---|---|---|---|
| Donor Treatment* | Dye | Step 1 | Step 2 | Step 3 | Step 4 | Step 5 |
| (Control) | M | 0.76 | 1.08 | 1.57 | 1.97 | 2.30 |
| | Y | 0.78 | 1.08 | 1.49 | 1.80 | 1.80 |

*This column shows different wash solutions used to treat the test donors for 30 minutes.

When compared against the control, the donor washed in a TX200 ® solution at 0.1% wt/wt in water does not show any improvement. This wash solution extracted only the residual salts from the coating which had been introduced with the gelatin and/or other constituents, leaving a residual of the surfactant and its salts in the donor.

When the donor coating was washed with either a 0.2% sodium sulfate solution or deionized water, an increase of 0.1 to 0.15 density units was observed for each subtractive color. In these two cases, the TX200 ® was extracted from the donor coating leaving behind a salt residue. In the case where the surfactant was removed from the coatings, a significant increase in density was obtained. This would enable one to use an increased writing speed to get an equivalent density.

Projected images were then visually evaluated for sharpness of the edges of the images. The results are given in Table IV as follows:

TABLE IV

| EDGE QUALITY IMPROVEMENT | |
|---|---|
| DONOR TREATMENT | RESULTS |
| Untreated | Very Poor |
| 0.1% (by wt.) TX200 ® Bath | Poor |
| 0.01% (by wt.) TX200 ® Bath | Fair |
| 0.001% (by wt.) TX200 ® Bath | Good |
| Tap Water | Good |
| Deionized Water | Very Good |

The above results indicate that there is an increase in the sharpness of the edges of images made with donor from which the surfactant had been removed by washing. There is increasing edge sharpness with decreasing concentration of TX200 ® in the wash solution.

Donors which were washed in deionized water and unwashed samples were then analyzed for the level of TX200 ®. The results are as follows:

TABLE V

| DONOR WASHED IN DEIONIZED WATER | | |
|---|---|---|
| | $MG/M^2$ TX200 ® SURFACTANT | |
| DONOR SAMPLE | UNWASHED | WASHED |
| Yellow | 182 | <1.08 |
| Magenta | 212 | <1.08 |
| Cyan | 266 | <1.08 |

1.08 = DETECTION LIMIT

The above results indicate that after washing all three donors with deionized water, the amount of TX200 ® is less than the detectable limit of 1.08 $mg/m^2$.

Donors which were washed in a TX200 ® solution and unwashed samples were then analyzed for the level of TX200 ®. The results are as follows:

TABLE VI

| DONOR WASHED IN TX200 ® SOLUTION | |
|---|---|
| SAMPLE | LEVEL TX200 ® $MG/M^2$ |
| CONTROL | 212 |
| WASHED WITH | |

TABLE VI-continued

| DONOR WASHED IN TX200 ® SOLUTION | |
|---|---|
| SAMPLE | LEVEL TX200 ® MG/M$^2$ |
| 0.001% TX200 ® | 1.08 |
| 0.01% TX200 ® | 1.08 |
| 0.1% TX200 ® | 63.2 |

1.08 = DETECTION LIMIT

The above results correlate with those for visual improvement in the edge sharpness given in Table IV. That is, as the level of TX200 ® in the wash solution is decreased, the sharpness of the image improves.

The invention has been described in detail with particular reference to preferred embodiments thereof, but it will be understood that variations and modifications can be effected within the spirit and scope of the invention.

What is claimed is:

1. A process of preparing a dye-donor element used in thermal dye-transfer processing comprising:

a) coating a support with a dye layer comprising an image dye dispersed in a binder, said binder comprising a hydrophilic polymer coated from an aqueous solution containing a surfactant;

b) washing said dye-donor element with water to remove residual surfactant in said dye layer; and c) drying said dye-donor element.

2. The process of claim 1 wherein said water is deionized.

3. The process of claim 1 wherein said water contains a salt.

4. The process of claim 3 wherein said salt is sodium sulfate.

5. The process of claim 1 wherein said hydrophilic polymer is gelatin.

6. The process of claim 1 wherein said dye-donor element also contains an infrared absorbing material.

7. The process of claim 6 wherein said infrared-absorbing material is in said dye layer.

8. The process of claim 7 wherein said infrared-absorbing material is a dye.

9. In a process of forming a thermal dye transfer image comprising:

I) contacting at least one dye-donor element comprising a support having thereon a dye layer comprising an image dye dispersed in a binder with a dye-receiving element comprising a support having thereon a polymeric dye image-receiving layer;

II) imagewise-heating said dye-donor element; and

III) transferring a dye image to said dye-receiving element to form said thermal dye transfer image, the improvement wherein said dye-donor element is prepared by:

a) coating a support with a dye layer comprising an image dye dispersed in a binder, said binder comprising a hydrophilic polymer coated from an aqueous solution containing a surfactant;

b) washing said dye-donor element with water to remove residual surfactant in said dye layer; and c) drying said dye-donor element.

10. The process of claim 9 wherein said water is deionized.

11. The process of claim 9 wherein said water contains a salt.

12. The process of claim 11 wherein said salt is sodium sulfate.

13. The process of claim 9 wherein said hydrophilic polymer is gelatin.

14. The process of claim 9 wherein said dye-donor element also contains an infrared-absorbing material.

15. The process of claim 14 wherein said infrared-absorbing material is in said dye layer.

16. The process of claim 15 wherein said infrared-absorbing material is a dye.

* * * * *